US006582330B1

(12) United States Patent
Rehkemper et al.

(10) Patent No.: US 6,582,330 B1
(45) Date of Patent: Jun. 24, 2003

(54) ELECTRONIC FOOTBALL CAPABLE OF MEASURING THROWING STATISTICS

(75) Inventors: Steven Rehkemper, Chicago, IL (US); Michael Kass, Willowbrook, IL (US); Bret Gould, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 37 days.

(21) Appl. No.: 09/848,196

(22) Filed: May 4, 2001

(51) Int. Cl.[7] ..... A63B 43/00
(52) U.S. Cl. ..... 473/570; 473/569; 446/484
(58) Field of Search ..... 273/108.4; 473/569–570; 446/484

(56) References Cited

U.S. PATENT DOCUMENTS

D262,717 S * 1/1982 Dweck ..... D21/13
4,534,557 A * 8/1985 Bigelow et al. ..... 273/55 A
5,260,512 A * 11/1993 Chomette et al. ..... 84/644
5,316,293 A * 5/1994 Hamilton ..... 273/65 EF
5,377,539 A * 1/1995 LaSalle ..... 73/146.8
5,490,047 A * 2/1996 O'Rourke et al. ..... 362/234
5,526,326 A * 6/1996 Fekete et al. ..... 368/10
5,533,921 A * 7/1996 Wilkinson ..... 446/409
5,779,576 A * 7/1998 Smith, III et al. ..... 473/570
6,032,536 A * 3/2000 Peeters et al. ..... 73/725
D439,620 S * 3/2001 Podd et al. ..... D21/329

* cited by examiner

*Primary Examiner*—S. Thomas Hughes
*Assistant Examiner*—Carnien D. White

(57) ABSTRACT

The electronic football of the present invention is capable of calculating various throwing statistics. The electronic football includes a start switch in communication with a timer means that starts when the start switch is released approximately simultaneously when the football is thrown. Upon impact, an impact switch triggers the timer to stop, thereby providing the total flight time. The electronic football further includes a pressure sensor positioned in an opening in the forward section of the football for measuring the air pressure when the football is thrown. The pressure readings are received by a microprocessor, which calculates the various throwing statistics. The throwing statistics may further be displayed on a display screen or emitted through a speaker.

21 Claims, 5 Drawing Sheets

ELECTRONIC FOOTBALL CAPABLE OF MEASURING THROWING STATISTICS

FIELD OF THE INVENTION

This invention relates generally to balls, and specifically to, a football that may be thrown and which includes means to measure and record specific throwing statistics, such as the distance the ball was thrown, the speed the ball was thrown and/or the length of time the ball was in the air, as well as other well known passing or throwing statistics.

BACKGROUND OF THE INVENTION

The competitiveness of throwing objects, such as baseballs, footballs, Frisbees™, and the like, are often the subject of many child and adult games. Many devices or objects have been the subject of the prior art to increase throwing attributes, such as the distance or height one may throw the object or the time the object remains in the air. However, the ability to accurately measure these throwing attributes has been largely ignored. While various devices such as velocity measuring devices equipped for measuring professional pitching speeds and hockey puck shots are widely used in professional and amateur sports, these devices are extremely costly to employ and are not designed to be placed within the objects themselves.

In U.S. Pat. No. 5,779,576 entitled "Throw-Measuring Football" (referred to herein as the '576 patent) a measuring apparatus is embedded within the football itself and measures the distance the football was thrown, the acceleration of the football and the time aloft. The '576 patent uses an accelerometer to measure the acceleration of the football. However, if the football is thrown with too severe of a loft the vertical component of the acceleration is greater then the horizontal component, causing the measurements to be inaccurate. In such conditions the '576 patent displays a "LOB" reading to indicate that the trajectory was too high (See Col 3, lines 20–25). In addition it was further found that if the football has the slightest wobble to the throw, there is an extra component that is added to the acceleration reading by the accelerometer that should be compensated for or else the calculations become inaccurate. It is therefore an object of the present invention to provide a more accurate measurement device that overcomes the shortcomings of the prior art.

SUMMARY OF THE INVENTION

In accordance with the present invention an electronic football is capable of calculating various throwing statistics. The electronic football includes a start switch in communication with a timer means that starts when the start switch is released substantially when the football is thrown. Upon impact, an impact switch triggers the timer to stop, thereby providing a total flight time. The electronic football further includes a pressure gauge positioned in an opening in the forward section of the football for measuring the air pressure when the football is thrown. The pressure readings are received by a microprocessor, which calculates the various throwing statistics. The throwing statistics may further be displayed on a display screen or emitted to the user through a speaker. The electronic football further includes the ability to track the history of the throwing statistics thereby providing the means to calculate averages as well as the maximum values during the history. The football may further include a tail that projects from the rearward section of the football providing a means to keep the football from wobbling.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 2:
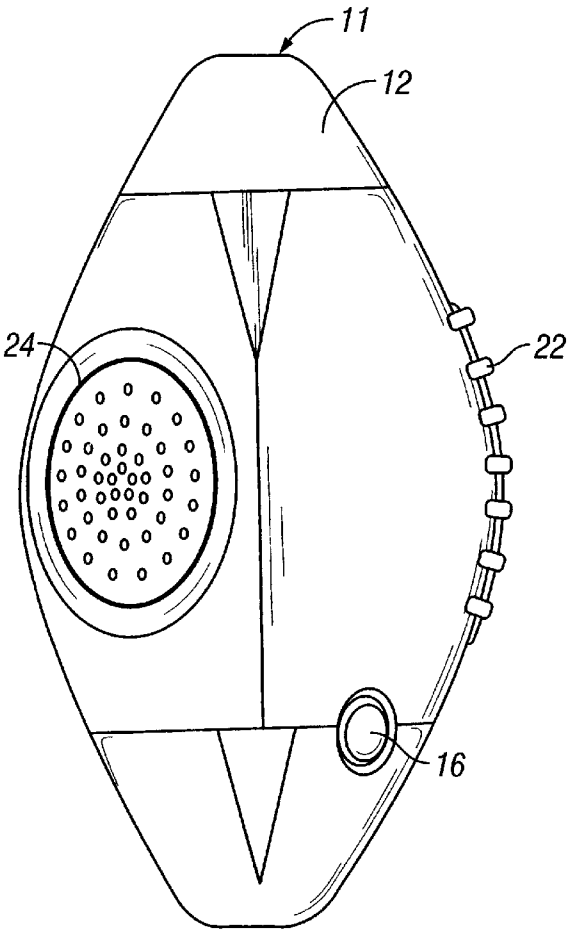
FIG. 2 is a perspective view of a second electronic football capable of measuring throwing statistics in accordance with the present invention having a speaker for emitting various throwing statistics.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 1:
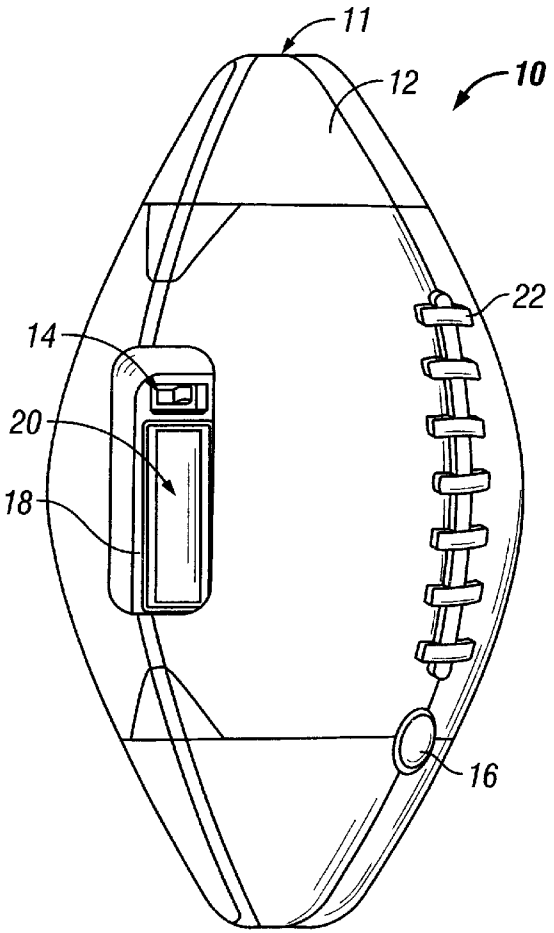
FIG. 1 is a perspective view of an electronic football capable of measuring throwing statistics in accordance with the present invention having a display screen for displaying various throwing statistics.

Referring first to FIG. 1, a football in accordance with the present invention is shown and generally referenced to as 10. The football is designed to provide the user with various throwing statistics. Such throwing statistics may include the distance the ball was thrown, the speed the ball was thrown, the length of time the ball was thrown (flight time) as well as calculating and storing the total distance, top speed, total flight time, averages and the total times the ball has been thrown. As opposed to other footballs that measure throwing statistics by measuring the initial acceleration with an accelerometer, the present invention measures velocity by using an air pressure gauge 11 mounted in the forward section of the football (shown and explained in greater detail below) providing the present invention with the ability to display throwing statistics for virtually any angle of trajectory.

Continuing to refer to FIG. 1, the football 10 includes an outer body 12 preferably made from a resilient foam material or other soft materials. However, it may also include other known materials such as leather, rubbers or synthetic mixtures. The football 10 further includes an on/off switch 14 and a start/restart button 16 that are mounted within the interior of the football 10 and positioned through the outer body 12. The above mentioned throwing statistics are displayed on a display screen 20 that is also set within the interior of the football 10 and is viewed through an opening 18 in the outer body 12. The football 10 may also include fabricated or molded laces 22 in order to provide the user with the proper means to grip and throw the football 10.

It is also contemplated that other well-known means for replaying the statistics may be employed, such as audibly emitting the statistics through a speaker 24, illustrated in FIG. 2. As such the statistics may be replayed in any well-known visual or audible means. After the ball is thrown, the thrower or a second person (generally referred to as "user") may retrieve the ball and view the throwing statistics on the display screen 20 or listen to the same through the speaker 24. The user may further be capable of scrolling through the statistics or through previously stored statistics (referred to as a "history") by pressing the start/restart button 16.

Figure 3:
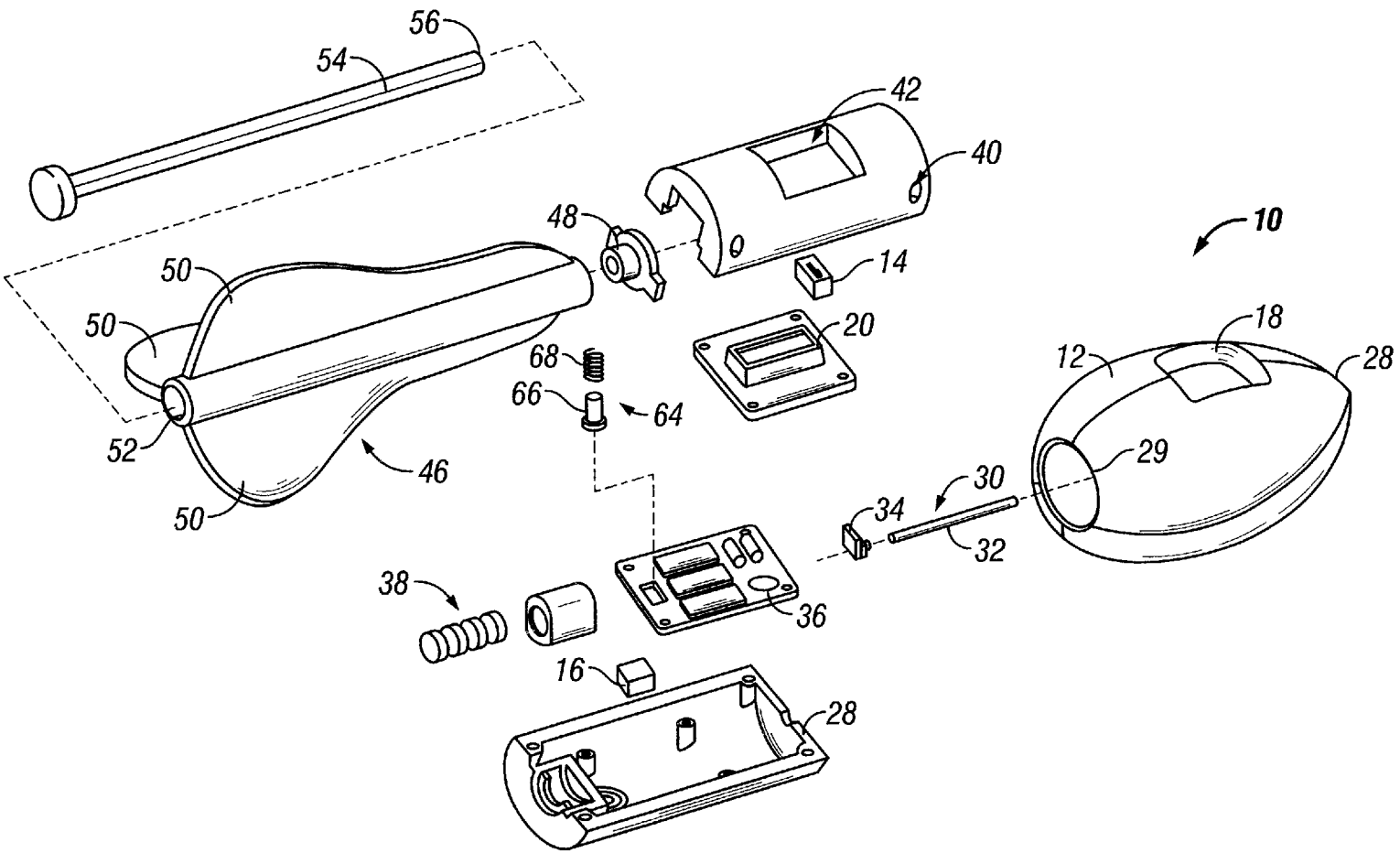
FIG. 3 is an exploded view of an electronic football in accordance with the present invention.

Referring now to FIG. 3, an exploded view of the football 10 illustrated in FIG. 1 is shown. The football 10 includes an outer body 12 that is preferably resilient to maintain a desired shape. The outer body 12 is also hollow and includes a small aperture (not shown) in the forward section 28 of the football 10 for receiving an air pressure gauge 30. The air pressure gauge 30 consists of a pitot tube 32 in communication with the atmosphere through the small aperture and connected to a pressure sensor 34 for measuring various air pressures traveling through the pitot tube 32. The information or data is stored by a memory means on a microprocessor 36, such that the data may be utilized to calculate the aforementioned throwing statistics. The calculations are discussed in greater detail below.

The microprocessor 36 is connected to a power source 38, such as a lithium battery cell; however, other well-known battery packs or power supplies may be utilized. In further communication with the power source 38 and the microprocessor 36 are the aforementioned on/off switch 14 and the start/restart button 16. A user may toggle the power supplied to the microprocessor 36 and other components through the on/off switch 14. The collected and calculated data is displayed or emitted through a display screen 20 or the speaker 24, depending upon the specific embodiment of the present invention. As illustrated in FIG. 3, the various electronic components are secured within a housing 40, which is preferably a two-piece construction.

The housing 40 is secured within the outer body 12 and includes a window 42 that aligns with the opening 18 in the outer body 12. The display screen 20 within the housing 40 is fastening therein such that it may be viewed through the window 42 of the housing 40 and as such through the opening 18 in the outer body 12.

The football 10 may further include a tail 46 that attaches to a bayonet mounting 48 secured within the rear section 29 of the football 10. However, the tail 46 may be secured within the housing 40. The tail 46 includes tail fins 50 that protrude radially from the tail 46. The tail 46 also includes a bore 52 that receives a tail fin rod 54. One end 56 of the tail fin rod is further secured to the bayonet mounting 48 along the same symmetrical axis of the football 10, thus securing the tail 46 to the football 10. Tail 46 stabilizes the flight of a thrown football, such that the forward section 28 is continually pointing forwards during flight. However, the tail 46 is not essential to the operation of the present invention.

Figure 4:
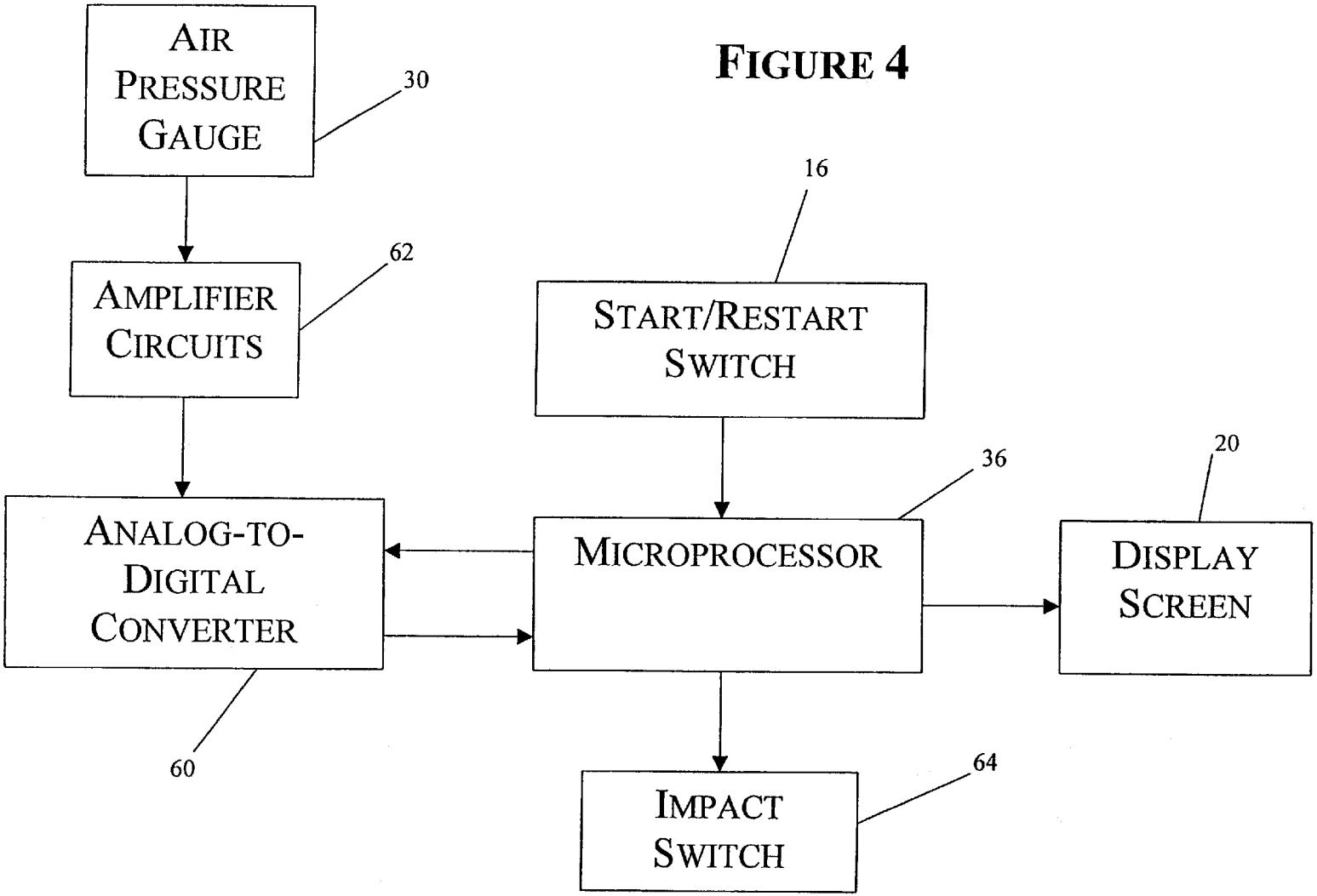
FIG. 4 is a block diagram illustrating the components of the electronics of the electronic football in FIG. 1.

During operation a user turns the football 10 on by toggling the on/off switch 14 to the on position. Gripping the football 10 about the laces 22, the user's thumb will also be position to press and hold down the start/restart button 16. Regardless of whether the user is left-handed or right-handed, when the football 10 is gripped about the laces 22 such that the forward section 28 is pointing in the direction the user wants to throw the football 10, the user's thumb will also be in position to hold down the start/restart button 16. Once the user releases the football 10, the user releases the start/restart button 16 approximately at the same time the football 10 is released. The instant the start/restart button 16 is released an internal timer (not shown) within the microprocessor 36 is started. This timer calculates the total flight time for each particular throw. Further illustration is shown by the block diagram in FIG. 4.

A fraction of a second after the football 10 is released the microprocessor 36 will take a series of readings from the air pressure gauge 30. The readings from the pressure gauge 30 are first fed through amplifier circuits 62 to an analog-to-digital converter 60 that is in communication with the microprocessor 36. The analog-to-digital converter 60 takes the analog signals from the pressure gauge 30 and converts the signals to digital signals.

When the football is caught or lands on the ground an impact switch 64 is triggered. The triggering of the impact switch 64 further causes the internal timer to stop, thereby providing the microprocessor 36 with the total flight time the ball was in the air. The impact switch 64 (also illustrated in FIG. 3) includes a post 66 with a spring 68 mounted on the microprocessor 36. Upon impact, the impact switch 64 sends a signal to the microprocessor 36, which will then immediately stop the internal timer. The flight time and pressure readings are used thereafter to calculate velocity and distance. These values are sent to the display screen 20 and can be scrolled through by depressing the start/restart switch 16. Once all the data is displayed the microprocessor 36 displays the word "READY" on the display screen 20 and the user is ready to throw the football 10 again. When the user is finished playing, the user may turn the display off, by toggling the on/off switch 14 to the off position. Alternatively, the football 10 may be equipped with an automatic shutoff that is set to turn off the football when not activated for a predetermined period of time. The user may also reset the stored data and start from the beginning by pressing and holding the start/restart button 16 for a predetermined period of time, for instance 3–5 seconds.

Figure 5:
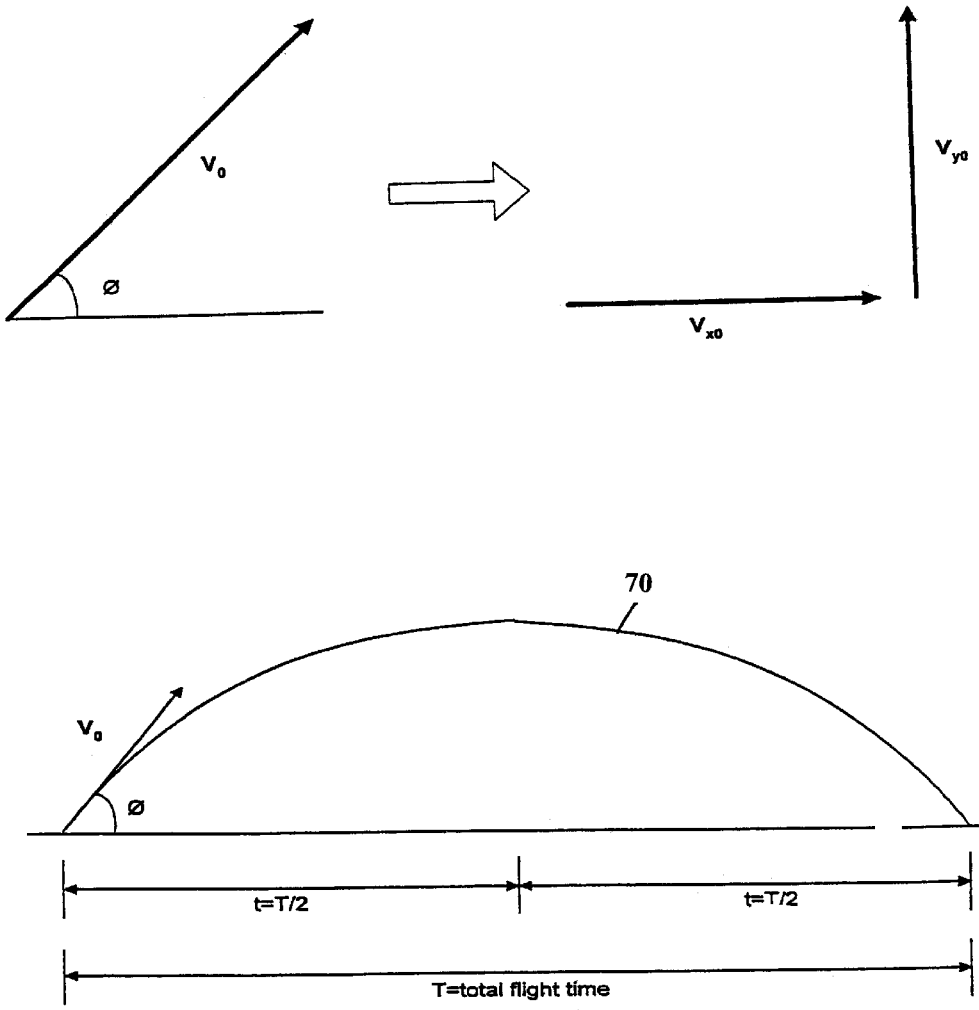
FIG. 5 is a representation of the trajectory of the electronic football with vertical and horizontal components.

A further discussion is now made in relation to the calculations made and used in determining the distance the football 10 is thrown. The equations for projectile motion govern, when calculating the distance ("D"), flight time ("T") and initial velocity ("$V_0$") for a thrown object. Illustrated in FIG. 5, the path 70 shows the typical path characterized by the thrown object. It is important to note that the following equations employ the fact that the projectile is thrown over a level plane. If you throw the football at around shoulder height but the other person catches it at their shoestrings, there will be some error introduced into distance calculations. In this case, the distance that the ball calculates would be greater than the actual distance due to the extra time the ball was in the air. A second source of error can be wind. The football uses a pressure gauge to determine ball velocity as it travels through the air. If there is a wind, this can affect the overall pressure readings by varying amounts depending on wind speed, wind direction, etc. For best results, the football should be thrown perpendicular to the direction of the wind.

Under vector analysis the initial total velocity $V_0$ may be broken into velocity components in both the x and y direction and is represented under the Pythagorean theorem as the square of the initial velocity is equal to the sum of the squares of the velocity in both the x and y direction.

$$V_0^2 = V_{x0}^2 + V_{y0}^2 \qquad [1.0]$$

where $V_0$ is the; $V_{x0}$ is the initial velocity in the x direction and $V_{y0}$ is the initial velocity in the y direction.

If the magnitude of $V_0$ can be determined, we can easily determine the magnitude of $V_{x0}$ and $V_{y0}$ by using the equations for projectile motion. We can also determine the angle that the ball was thrown from this information. Using the equations under projectile motion, we know that:

$$V_y=V_{y0}-g\cdot t \quad [2.0]$$

where $V_y$ is the velocity in the y direction; g is the acceleration of gravity and t is ½ the total flight time (T) or $^T/2$. When the football reaches the maximum height in its trajectory, the velocity in the y direction is 0. Thus, we can determine the y-component of the initial velocity may be set to zero at the top of the trajectory, such that the above equation becomes:

$$V_y=-g\cdot t \quad [3.0]$$

In the case of projectile motion, the velocity that the ball leaves the ground, ignoring the effects of air friction and assuming that the ball is thrown over a flat plane, is equal to the velocity that the ball has when it hits the ground at the end of its flight. Thus $$V_y=V_{y0} \quad [4.0]$$

Since we know $V_0$ and $V_{y0}$, we can solve for $V_{x0}$ from equation 1.0. Thus:

$$V_x=\sqrt{(V_0^2-V_y^2)} \quad [5.0]$$

Figure 6:
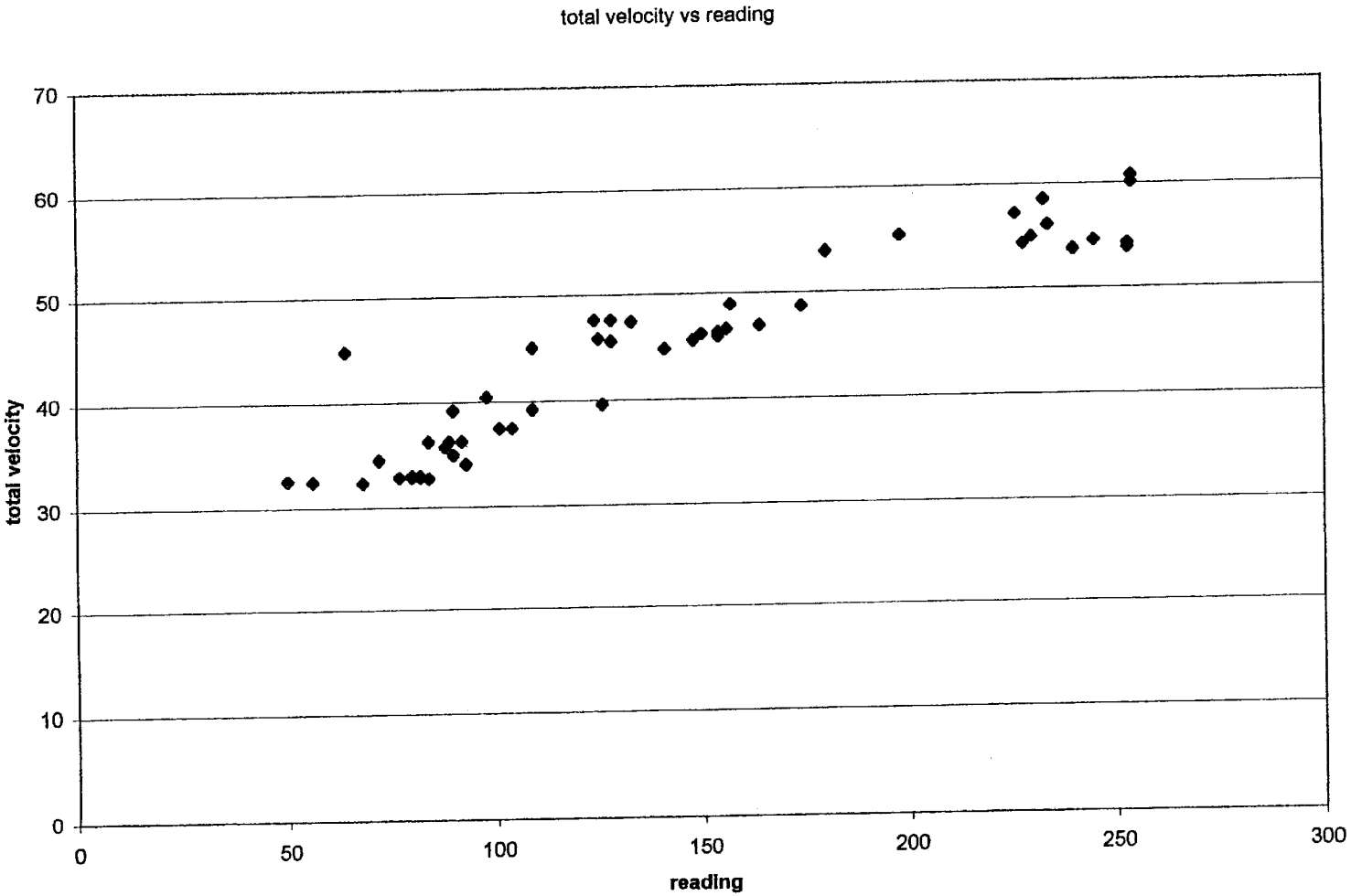
FIG. 6 is a table illustrating test data plotted from various pressure readings versus total initial velocity permitting the use of a best-fit-line to determine the total initial velocity from a given pressure reading.

Since the pressure sensor is designed to have a linear output over its specified range, a linear equation (y=m·x+b) can be used to approximate velocities over wider ranges, where y and x are components in the x, y axis, and m and b are defined as the slope of the line and the y intercept, respectively. FIG. 6 illustrates test data taken for pressure readings versus total initial velocity for a thrown football 10. Since the pressure sensor has a linear output a linear equation may be extrapolated from the test data using a best-fit straight line. The linear equation may further be defined as:

$$V_0=m\cdot(pr)+b \quad [6.0]$$

where $V_0$ is the initial total velocity, m is the slope, pr is the pressure reading and b is the intercept. From a best-fit line determination it was found that m is approximately 0.1448643, and b is approximately 24.4271248.

Furthermore, since projectile motion provides that the distance the ball traveled in the x-direction (or the football's range) is determined from:

$$D=V_{x0}\cdot T \quad [7.0]$$

the above equations may be substituted into equation [7.0], yielding:

$$D=(\sqrt{(m\cdot pr+b)^2-(g\cdot t)^2})\times 2t \quad [8.0]$$

In addition thereto, the angle the ball was thrown at can also be solved from either $V_{y0}=V_0 \sin Ø$ or $V_{x0}=V_0 \cos Ø$ where Ø is the angle. Similarly, the aforementioned equations can be used to determine other flight characteristics, for instance the total height of the football at the top of its path, or the top speed, which would be determined from the maximum pressure sensor reading taken within a short time period after releasing the start/restart button.

From the foregoing and as mentioned above, it will be observed that numerous variations and modifications may be effected without departing from the spirit and scope of the novel concept of the invention. It is contemplated that the above invention may be used with a glider or airplane or other thrown projectiles. Moreover, it is readily apparent that the equations represented above are but one way in determining the throwing statistics and the calculated best-fit line may be adjusted if the pressure sensor outputs a maximum value at a distance shorter than what is desired as a maximum distance reading, such that new data may be plotted and recalculated to determine a subsequent best fit line equation. It is to be understood that no limitation with respect to the specific methods and apparatus illustrated herein is intended or should be inferred. It is, of course, intended to cover by the appended claims all such modifications as fall within the scope of the claims.

What is claimed is:

1. An electronic football capable of calculating throwing statistics comprising:

a housing;

a resilient outer body placed about the housing, the outer body having a forward section that includes an opening;

an air pressure gauge positioned in the opening of the forward section for measuring air pressure when the football is thrown;

an analog-to-digital conversion means for receiving a pressure sensor reading from the pressure gauge and converting said pressure sensor reading to a digital pressure sensor reading;

a microprocessor having a timer means and a memory means, the timer means for determining a total flight time and the memory means for storing throwing statistics, the microprocessor is secured within the housing and is in communication with the analog-to-digital conversion means for receiving the digital pressure sensor reading and the flight time in order to calculate throwing statistics;

a means for replaying the throwing statistics in communication with the microprocessor; and a battery source for providing power to said microprocessor.

2. The electronic football of claim 1, wherein the microprocessor calculates the total distance (D) of each throw based upon the following formula:

$$D=(\sqrt{(m\cdot pr+b)^2-(g\cdot t)^2})\times 2t$$

where g is the gravitational acceleration of the earth, t is ½ of the total flight time, m and b are best-fit-line constants, and pr is the digital pressure reading.

3. The electronic football of claim 1, wherein the microprocessor calculates a top speed of each throw.

4. The electronic football of claim 1, wherein the memory means further stores a history of the throwing statistics such that the microprocessor may calculate and re-calculate an average and a maximum value after subsequent throws, and wherein the microprocessor may be accessed to replay said average and maximum values.

5. The electronic football of claim 1 further including a start button and an impact switch in communication with the timer means, the start button when pressed and released indicates to the timer means that the flight time has begun and the impact switch indicates to the timer means that the flight time has ended.

6. The electronic football of claim 5, wherein the impact switch includes a spring attached to a post in communication with the microprocessor, such that when the football comes to a stop, the impact switch signals the microprocessor that the flight time has ended.

7. The electronic football of claim 1 further comprising an on/off switch in communication with the battery source.

8. The electronic football of claim 1, wherein the means for replaying the throwing statistics is a display screen.

9. The electronic football of claim 1, wherein the means for replaying the throwing statistics is a speaker.

10. The electronic football of claim 1 further including a tail attached to a rear end of said football, the tail extending along a symmetrical axis of the football and having fins protruding radially therefrom.

11. A football having an apparatus for measuring throwing statistics of the football when thrown by a user where said apparatus is mounted within said football, said apparatus comprising:

means for timing a total time the football is in the air starting from the moment the football is released by the user to the moment the football impacts the ground or is caught by a subsequent user;

means for reading air pressure while the football is in the air and to generate a signal representative of the air pressure reading;

means for receiving the air pressure reading and a total time and calculating the total distance the football traveled while said football was thrown; and means for replaying said total distance to said user.

12. The football of claim 11, wherein the total distance (D) is calculated from the following mathematical formula:

$$D=(\sqrt{(m\cdot pr+b)^2-(g\cdot t)^2})\times 2t$$

where g is the gravitational acceleration of the earth, t is ½ of the total time, m and b are best-fit-line constants, and pr is the air pressure reading.

13. The apparatus of claim 11, wherein the air pressure reading includes a pressure sensor attached to a pitot tube, the pitot tube being placed in an aperture defined in a forward end of the football.

14. The apparatus of claim 11, wherein the means for receiving the air pressure reading and the total time and calculating the total distance is performed by a microprocessor having memory means for storing a history of the total distance for each throw, such that the microprocessor may calculate an average and maximum from said history of the total distances.

15. The football of claim 14, wherein the microprocessor further calculates a top speed of each throw.

16. The football of claim 11, wherein the replaying means is a display screen mounted within the device and viewable therethrough.

17. The football of claim 11, wherein the replaying means is a speaker.

18. The football apparatus of claim 14, wherein the microprocessor includes the timing means that is in further communication with a start button that is released upon throwing the football, which starts the total time and is in communication with an impact switch that is triggered upon hitting an object, which ends the total time.

19. An electronic football capable of measuring flight characteristics comprising:

an start button that may be released when the football is thrown, the start button in communication with a timer such that when released, the start button begins the timer;

an impact switch that is triggered when the football comes into contact with another object, the impact switch is in communication with the timer such that when triggered, the impact switch stops the timer to provide a total flight time;

an air pressure gauge positioned in an aperture in a forward section of the football, the air pressure gauge in communication with a microprocessor, the air pressure gauge provides the microprocessor with various pressure readings of the air when the football is thrown through the air;

the microprocessor having a means to convert the total flight time and the various pressure readings into flight characteristics; and a means to replay said flight characteristics.

20. The football of claim 19, wherein the flight characteristics include but is not limited to a total distance the football traveled during the flight time, a speed of the football during the flight time and the total flight time.

21. The football of claim 20, wherein the microprocessor further includes memory means to record the flight characteristics such that the microprocessor may calculate an average value for the flight characteristics and calculate a maximum value.

* * * * *